US012576897B2

(12) United States Patent
Pfeifer et al.

(10) Patent No.: US 12,576,897 B2
(45) Date of Patent: Mar. 17, 2026

(54) CABLEWAY WITH A VEHICLE HAVING A CLOSURE DRIVE AND FAILSAFE LOCKING MONITORING

(71) Applicant: Innova Patent GmbH, Wolfurt (AT)

(72) Inventors: Daniel Pfeifer, Sankt Anton am Arlberg (AT); Clemens Mohr, Wolfurt (AT); Helmut Nagel, Hochst (AT)

(73) Assignee: Innova Patent GmbH, Wolfurt (AT)

( * ) Notice: Subject to any disclaimer, the term of this patent is extended or adjusted under 35 U.S.C. 154(b) by 535 days.

(21) Appl. No.: 18/257,803

(22) PCT Filed: Dec. 15, 2021

(86) PCT No.: PCT/EP2021/085818
§ 371 (c)(1),
(2) Date: Jun. 15, 2023

(87) PCT Pub. No.: WO2022/129123
PCT Pub. Date: Jun. 23, 2022

(65) Prior Publication Data

US 2024/0075971 A1 Mar. 7, 2024

(30) Foreign Application Priority Data

Dec. 17, 2020 (AT) ..... A 51109/2020

(51) Int. Cl.
*B61L 27/20* (2022.01)
*B61B 7/06* (2006.01)
(Continued)

(52) U.S. Cl.
CPC ..... *B61L 27/20* (2022.01); *B61B 7/06* (2013.01); *B61B 12/06* (2013.01); *B61L 27/70* (2022.01)

(58) Field of Classification Search
CPC . B61L 27/20; B61L 27/70; B61B 7/06; B61B 12/06
See application file for complete search history.

(56) References Cited

U.S. PATENT DOCUMENTS 8,710,977 B2 * 4/2014 Gubler ..... B61B 12/002 340/542
11,332,166 B2 * 5/2022 Mohr ..... B61B 12/002
2010/0085183 A1 4/2010 Gubler

FOREIGN PATENT DOCUMENTS

AT 7001 U1 7/2004
EP 2067682 A1 6/2009
(Continued)

OTHER PUBLICATIONS

International Search Report and Written Opinion dated Mar. 29, 2022 for International Pat. Appl. No. PCT/EP2021/085818.

*Primary Examiner* — Robert J McCarry, Jr.
(74) *Attorney, Agent, or Firm* — Husch Blackwell LLP

(57) ABSTRACT

For reliable, failsafe monitoring of the locking of a closure device of a vehicle of a cableway is disclosed in which provision is made for an electrical connection to be established between a vehicle powerline modem on the vehicle and a station powerline modem, which is connected to the cableway controller, via a busbar in the station, with which contact is made by a current collector of the vehicle, and for the locking status of a locking unit to be transmitted from the vehicle to the cableway controller via this connection by means of powerline communication, wherein, in the event of defective locking, the vehicle is stopped in the region of a busbar in the station and the locking status is transmitted to the cableway controller again when the vehicle is at a standstill.

10 Claims, 2 Drawing Sheets

(51) Int. Cl.
*B61B 12/06* (2006.01)
*B61L 27/70* (2022.01)

(56) References Cited

FOREIGN PATENT DOCUMENTS

| | | | | | |
|---|---|---|---|---|---|
| EP | 3476686 | A1 | | 5/2019 | |
| JP | H02231263 | A | | 9/1990 | |
| JP | 2020083234 | A | | 6/2020 | |
| WO | 2008138154 | A1 | | 11/2008 | |
| WO | WO-2015196221 | A1 | * | 12/2015 | ..... B61B 12/00 |
| WO | 2018228965 | A1 | | 12/2018 | |

* cited by examiner

CABLEWAY WITH A VEHICLE HAVING A CLOSURE DRIVE AND FAILSAFE LOCKING MONITORING

CROSS REFERENCE

This application is a U.S. National Phase Application of International Application No. PCT/EP2021/085818 filed on 15 Dec. 2021, which claims priority to Austrian Patent Application No. A51109/2020 filed on 17 Dec. 2020, the disclosures of each of which are expressly incorporated herein by reference in their entirety.

TECHNICAL FIELD

The present disclosure relates to a method for operating a cableway comprising at least one vehicle, wherein at least in one station of the cableway, a closure device of the vehicle is closed by a closure drive, and the closed closure device is locked by a locking unit, wherein a locking status of the locking unit is detected by a locking monitor and transmitted to a cableway controller, and the travel of the vehicle out of the station is prevented by the cableway controller in the event of defective locking. The present disclosure also relates to a correspondingly designed cableway.

BACKGROUND

Cableways are frequently used for transporting people. For this purpose, a number of cable-drawn vehicles of the cableway are moved between at least two stations. Typical cableways are aerial cableways comprising vehicles, such as gondolas, cabins, or chairs, suspended in the air on a support or hoisting cable, or funicular railways comprising cable-drawn vehicles traveling on rails or other guideways. Vehicles of a cableway typically comprise closure devices, such as doors, typically in the case of gondolas, cabins, or rail vehicles, or restraining bars, typically for chairs, which are designed to prevent people being transported between stations from leaving the vehicle. For this purpose, the closed closure devices are also locked in the stations before departure and the lock mechanism is monitored to prevent inadvertent or improper opening of the closure device. The vehicle can leave the station only when the locked state is confirmed. Common lock mechanisms are mechanical lock mechanisms, for example, a catch, a latch, or a detent that engages when the closure device is closed. The latching state is also frequently mechanically checked or sensed, for example, by means of a roller lever. However, these purely mechanical solutions are mechanically elaborate, sensitive with regard to adjustments, and can also lead to an unintentional faulty operation. For example, the user may make the mistake of simply resetting the mechanical device of the lock mechanism without locking the door.

Therefore, electronic or electrical locking monitors have become known. The fundamental difficulty of electrical locking monitoring is to carry out the locking monitoring in a failsafe manner, in the sense of functional safety. For this purpose, the locking monitoring must reach a specific safety level, for example a specific safety integrity level (SIL) according to EN 61 508. In an electrical design of the locking monitor, the locking is monitored by means of electrical contacts (limit switches) and the status of the electrical contacts is transmitted to the cableway controller. The electrical contacts and the cableway controller can easily be made failsafe, for example by redundant contacts and a failsafe controller. However, the transmission channel between the contacts and the cableway controller is not failsafe in terms of functional safety with simple transmission systems. In the absence of functional safety, the locking status may be transmitted to the controller in a faulty manner, for example via the non-secure transmission channel, for example the controller receives the information that locking has been performed, even though the locking has not taken place correctly. Therefore, other measures must be taken in order to make the locking monitoring of the closure device failsafe. In particular, it must be ensured that the vehicle cannot leave the station without locking.

If the closure device is not locked, departure of the vehicle from the station must be prevented for safety reasons. In the event of a faulty lock mechanism, the operating personnel of the cableway generally receives an error message and the cableway is stopped. The operating personnel must subsequently check the closure device of the vehicle prior to its departure and acknowledge the error message after checking or eliminating the error. The cableway can be restarted and the vehicle can leave the station only after the error message is acknowledged. However, in practice, it has been shown that the operating personnel, particularly in stress situations, can make a mistake and only insufficiently check such an error, not correct the error, or even acknowledge the error message without checking, which results in the vehicle leaving the station without a locked closure device.

Therefore, it is provided in WO 2018/228965 A1 to query the locking status again after the vehicle has started up. This second query is carried out in the station in such a way that the exit of the vehicle from the station can still be prevented if an unsuccessful locking was detected in the second query. The double query enables the required fail-safety to be achieved. In WO 2018/228965 A1, the transmission channel is designed as a non-failsafe radio channel, for example comprising RFID transponders. When using passive transponders, a power supply on the vehicle can thus also be dispensed with. The use of a radio channel makes this system more laborious and more complex, because additional devices are required in the station and on the vehicle compared to the technical devices which are present anyway. Apart from this, the RFID transmission is sensitive to the harsh ambient conditions (temperatures, moisture, ice, snow, etc.) in the surroundings of a cableway, which can negatively affect the availability of the transmission channel. In particular in safety-critical applications, such as door locking monitoring, this can be a problem.

It is therefore an object of the present disclosure to specify an electric locking monitor of a closure device of a vehicle of a cableway that can be implemented with simpler means and is reliable.

SUMMARY

Embodiments of the present disclosure use powerline communication to transmit the locking status to the cableway controller. In this case, existing devices, in particular electrical lines and connections, of the cableway can thus be used for the powerline communication. Only powerline modems and, if applicable, a small electrical buffer storage, are to be provided, which, however, requires only little effort and costs. The arrangement of the busbar, preferably the provision of two busbars one after the other, makes it possible to ensure that the vehicle does not move out of the station when the locking is defective. The vehicle is stopped in the region of a busbar, and a start-up of the cableway is possible only after the establishment of a locking or establishment of a safe state. Since the vehicle stops in any case in the region of a busbar, the locking status can be queried by means of powerline communication. This makes it possible to reliably prevent a vehicle from leaving the station without proper locking of the closure device.

In some embodiments, the locking evaluation unit and the vehicle powerline modem are supplied with electrical energy via the first or second busbar. The electrical energy for powerline communication can thus be obtained via the busbar, and only a small-dimensioned electrical buffer storage is required in order to be able to maintain the powerline communication for a short period of time despite an inactive busbar.

The busbar may be used for the electrical supply of the closure device, in that the current collector of the vehicle contacts the first busbar during travel through the station in a direction of movement, before the closure device is closed, and the closure drive is designed as an electric drive, wherein the electrical closure drive is supplied with electrical energy via the first busbar. In this case, it is advantageous for the busbar to be activated only when the current collector is already in contact with the busbar, because this can prevent sparking.

After closing and locking of the closure device, and before the locking status is transmitted, the busbar can be deactivated, because the closure drive is no longer required. In order to then be able to transmit the locking status via powerline communication, the locking evaluation unit and the vehicle powerline modem are supplied with electrical energy for this purpose by an electrical energy supply on the vehicle. It can thus also be ensured that the busbar is deactivated when the current collector loses contact with the busbar, as a result of which sparking can be prevented.

These objects are merely illustrative of the features and advantages associated with the present disclosure and should not be deemed as limiting in any manner. These and other objects, features and advantages of the present disclosure will become apparent from the following detailed description when taken in conjunction with the referenced drawings.

BRIEF DESCRIPTION OF THE DRAWINGS

Reference is now made more particularly to the drawings, which illustrate the best presently known mode of carrying out the present disclosure and wherein similar reference characters indicate the same parts throughout the views.

DETAILED DESCRIPTION

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. The following definitions and non-limiting guidelines must be considered in reviewing the description of the technology set forth herein.

In the following detailed description numerous specific details are set forth in order to provide a thorough understanding of the present disclosure. However, it will be understood by those skilled in the art that the present disclosure may be practiced without these specific details. For example, the present disclosure is not limited in scope to the particular type of industry application depicted in the figures. In other instances, well-known methods, procedures, and components have not been described in detail so as not to obscure the present disclosure.

The headings and sub-headings used herein are intended only for general organization of topics within the present disclosure and are not intended to limit the disclosure of the technology or any aspect thereof. In particular, subject matter disclosed in the "Background" may include novel technology and may not constitute a recitation of prior art. Subject matter disclosed in the "Summary" is not an exhaustive or complete disclosure of the entire scope of the technology or any embodiments thereof. Classification or discussion of a material within a section of this specification as having a particular utility is made for convenience, and no inference should be drawn that the material must necessarily or solely function in accordance with its classification herein when it is used in any given composition.

The citation of references herein does not constitute an admission that those references are prior art or have any relevance to the patentability of the technology disclosed herein. All references cited in the "Detailed Description" section of this specification are hereby incorporated by reference in their entirety.

Figure 1:
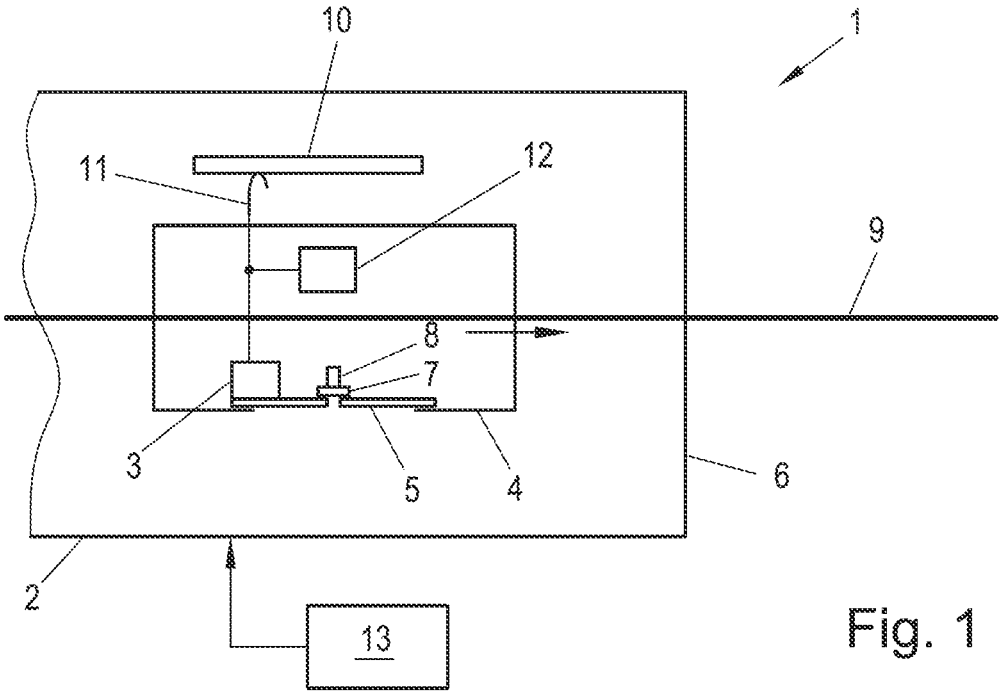
FIG. 1 is a schematic view of a station of a cableway with a vehicle having a closure device and locking monitoring according to an embodiment of the present disclosure.

In FIG. 1, a first station 2 of a cableway 1 is indicated. Well-known devices of the cableway 1 in the station 2, such as a bullwheel for a cable 9, a cable drive or tensioning devices for the bullwheel, a conveyor drive for moving vehicles uncoupled from the cable etc., on the vehicle 4, such as suspension gear, detachable grips, etc., and on the track, for example, supports having support rollers for the cable 9, etc., or in a second station, are not shown because they are not relevant to the present disclosure. By means of the cable 9, at least one vehicle 4 is conveyed between the first station 2 and a second station that is not shown. For this purpose, the vehicle 4 can be fixedly connected to the cable 9 in a likewise well-known manner, or can be detachable from the cable by means of spring-actuated detachable grips. The connection of the vehicle 4 to the cable 9, for example in the form of suspension gear, is also known and therefore not shown. In the following, the present disclosure shall be described without loss of generality by the example of a cabin as the vehicle 4 and with sliding doors as a closure device 5.

In the station 2, the closure device 5 is opened to allow the exiting and boarding of passengers. For that purpose, the vehicle 4 can come to a standstill in the station 2 or be moved through the station 2 at a low speed. Before the station exit 6 of the station 2, the closure device 5 is closed by means of a closure drive 3. The closure drive 3 can be designed electrically or mechanically. The electrical closure drive 3 can be any electric drive which is operatively connected to the closure device 5 for opening/closing, and also comprises a closure controller. A mechanical closure drive 3 uses, for example, a relative movement between the vehicle and the station in order to actuate the closure device 5 via rollers, levers, a control cable or similar actuating means. The electrical closure drive 3 can be supplied with electrical energy from the station 2 in the station 2. It is also conceivable that an electrical energy supply is provided on the vehicle 4, which supplies the electrical closure drive 3 with electrical energy.

For the electrical supply of the vehicle 4 or another electrical consumer 12 of the vehicle 4 (such as the electrical closure drive 3), a busbar 10 (also multi-phase) can also be provided in the station 2. For this purpose, a current collector 11, for example a sliding contact (also multi-phase), is provided on the vehicle 4, which current collector electrically contacts the busbar 10. During the power supply via the busbar 10, the electrical closure drive 3 can be actuated in order to open or close the closure device 5. The busbar 10 is preferably arranged in a stationary manner in the station 2, for example on a stationary component of the station 2.

Of course, a plurality of busbars 10 can be provided in the station 2. For example, a first busbar in the region before a boarding and exit point or after a station entrance, in order to be able to supply electrical energy to the electrical closure drive 3 for opening the closure device 5. A further busbar 10 can be provided in the region before the station exit 6 from the station 2, in order to be able to supply the closure drive 3 with electrical energy for closing the closure device 5. However, it is of course also possible to provide only a single busbar 10 for the electrical supply of the electrical closure drive 3 in the station 2.

Of course, the electrical supply via a busbar 10 in the station 2 can also be used, if necessary, for the electrical supply of other electrical consumers 12 of the vehicle 4, even without an electrical closure drive 3, or also for charging an electrical energy storage 20 on the vehicle 4.

A locking unit 7 is provided on the vehicle 4, by means of which locking unit the closed closure device 5 is locked such that an inadvertent or improper opening of the closure device 5 is prevented. The locking can take place mechanically or electrically. In the case of an electrical locking unit 7, the latter can be supplied with electrical energy via a busbar 10 or an electrical energy storage 20 on the vehicle 4, just like the closure drive 3 of the closure device 5. The locking unit 7 can be integrated in the closure drive 3 and can also be controlled by the closure controller of the closure drive 3.

Furthermore, the vehicle 4 is provided with a locking monitor 8 which detects the state of the locking unit 7. The locking monitor 8 is designed as a sensor, for example as an electrical limit switch comprising a double contact (NC contact, NO contact) which detects the state of the locking unit 7, i.e. whether locking has taken place or not. The locking monitor 8 can of course also detect the successful unlocking, for example in the region before a boarding and exit point of the station 2. However, the type and operating principle of the sensor of the locking monitor 8 is irrelevant to the present disclosure. The locking monitor 8 transmits the detected locking status to a cableway controller 13, which controls at least one function of the cableway 1 as a function of the locking status. In particular, the exit of the vehicle 4 from the station 2 is controlled as a function of the locking status, as will be explained in more detail below. The cableway controller 13 can be arranged at any point of the cableway 1, either in the first station 2 or another station. A distributed control of the cableway 1 comprising a plurality of connected control units is also conceivable in principle as a cableway controller 13.

The cableway controller 13, or a single control unit of the cableway controller, can be designed as processor-based hardware, on which control software runs, for example a computer, a microcontroller or a programmable logic controller. An implementation as an integrated circuit (IC), for example an application-specific integrated circuit (ASIC) or field programmable gate array (FPGA), is also conceivable. Individual control units can also be implemented as analog circuits. Mixed forms are also possible.

Figure 2:
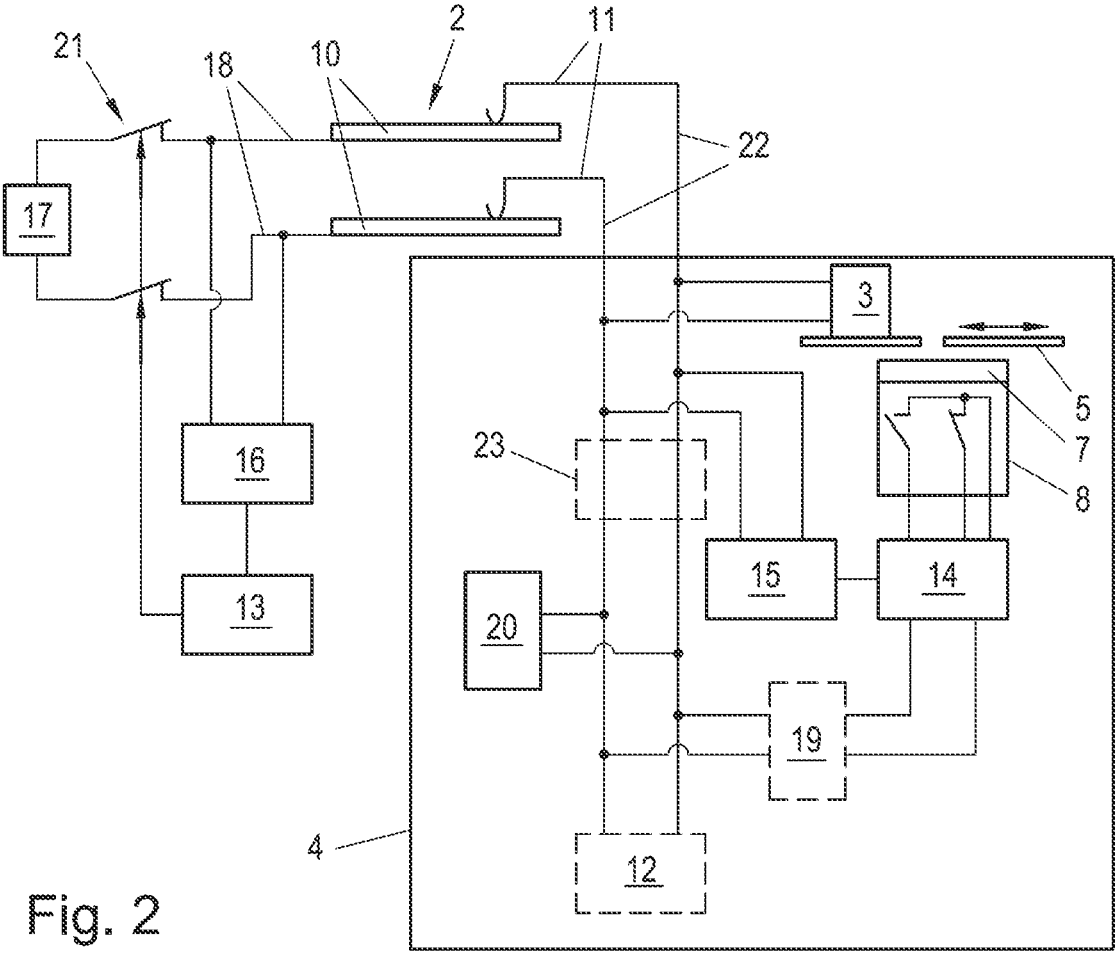
FIG. 2 is a schematic view of a powerline communication between the vehicle and the cableway station according to an embodiment of the present disclosure.

In order to transmit the locking status from the locking monitor 8 to the cableway controller 13, it is provided to use preferably existing electrical lines, for example for the electrical supply of the electrical closure drive 3 and/or a consumer 12 of the vehicle 4, in order to establish a local data communication network for data transmission, so that no additional cabling is required. For this purpose, for example, standardized or proprietary powerline communication can be used, as explained in more detail with reference to FIG. 2.

The signals of the locking monitor 8 (in the example according to FIG. 2 a limit switch comprising a double contact) are evaluated in a locking evaluation unit 14. The locking status as a result of the evaluation in the locking evaluation unit 14 is transmitted using a vehicle powerline modem 15. The vehicle powerline modem 15 can of course also be integrated in the locking evaluation unit 14. For this purpose, the vehicle powerline modem 15 is connected to the current collector 11, for example via the electrical supply line 22 to the vehicle 4, which in turn is connected to the current collector 11. On the station side, the first busbar 10 is connected to a first station powerline modem 16, which is connected to the cableway controller 13. The station powerline modem 16 can of course also be integrated in the cableway controller 13.

On the station side, the busbar 10 (two-phase in FIG. 2 for phase and neutral conductor) can be supplied with electrical energy, for example with ±24 VDC, via an electrical supply line 18 (two-phase in FIG. 2) from an electrical power supply 17 of the cableway 1. The first station powerline modem 16 can be connected to the supply line 18.

The electrical supply of the busbar 10 can also be interrupted by means of a separator unit 21, for example in a manner controlled by the cableway controller 13. The separator unit 21 is to be provided such that the electrical connection between the station powerline modem 16 and the busbar 10 is not interrupted thereby, but only the electrical supply of the busbar 10. However, for powerline communication, it is not absolutely necessary for the busbar 10 to be actively energized by a power supply. The busbar 10 may also be provided only for powerline communication, or be separated from the power supply 17 at the time of the powerline communication.

If the current collector 11 of the vehicle 4 electrically contacts the first busbar 10, an electrical connection between the vehicle powerline modem 15 and the station powerline modem 16 is established, via which powerline communication can take place. The locking status can thus be transmitted from the vehicle powerline modem 15 to the station powerline modem 16. Any data communication protocol can be implemented for this purpose. For the transmission of the locking status, it is therefore possible to resort to existing devices, in particular an existing electrical installation, of the cableway 1. Only powerline modems 15, 16 are additionally to be provided, but this is possible with little effort and cost.

The locking evaluation unit 14 can be designed as microprocessor-based hardware, on which evaluation software runs, for example in the form of an embedded controller or microcontroller. An implementation as an integrated circuit (IC), for example an application-specific integrated circuit (ASIC) or field programmable gate array (FPGA), is also conceivable. The locking evaluation unit 14 can also be implemented as an analog circuit. The powerline modems 15, 16 are usually electronic components, sometimes also comprising a microprocessor and firmware.

The locking evaluation unit 14 can also be supplied with electrical energy via the supply line 22. Alternatively or additionally, an electrical energy storage 20 for supplying the locking evaluation unit 14 can be provided on the vehicle 4. The locking evaluation unit 14 is preferably active when the current collector 11 is connected to the first busbar 10. In this case, the supply line 22 can be electrically energized, and the locking evaluation unit 14 can be advantageously supplied with electrical energy by the busbar 10. For this purpose, a voltage converter 19 can also be provided, if required, in order to convert the supply voltage of the busbar 10, for example 24 VDC for an electrical closure drive 3, to a required supply voltage of the locking evaluation unit 14, for example 5 VDC.

A known powerline coupling network, for example a transformer, a filter, etc., can also be provided between the vehicle powerline modem 15 or the station powerline modem 16 (or also both) and the current collector 11 or the first busbar 10. Such a powerline coupling network can of course also be integrated in the respective powerline modem 15, 16.

Likewise, an electrical energy storage 20 for the powerline communication can be provided on the vehicle 4. The electrical energy storage 20 can be charged via the busbar 10 and the supply line 22 when the vehicle 4 is connected thereto via the current collector 11. If the vehicle 4 is not connected to the busbar 10, an electrical supply of certain consumers 12 of the vehicle 4, at least for a particular period of time, can also be maintained by means of the electrical energy storage 20 which is connected to the current collector 11 or the supply line 22. The electrical energy storage 20 can be designed, for example, as buffer storage in the form of a supercapacitor, by means of which at least a powerline communication can be established and carried out for a required time period.

A rectifier 23, for example a diode bridge rectifier, can also be provided between the closure drive 3 and the electrical energy storage 20 in the supply line 22. The rectifier 23 can generate a unipolar feed voltage for the locking evaluation unit 14 from a bipolar supply voltage (e.g. ±24 VDC) or an AC voltage as the supply voltage, also via a voltage converter 19. At the same time, the rectifier 23 also ensures that the electrical energy storage device 20 is non-reactive in the direction of an electrical closure drive 3 because the rectifier does not allow energy to flow in the opposite direction. Of course, the rectifier 23 must not interrupt the powerline communication and is therefore to be arranged accordingly in the vehicle 4. For this purpose, the vehicle powerline modem 15 is connected to the supply line 22 for example between the current collector 11 and the rectifier 23.

In order to prevent disturbances due to the powerline communication via the electrical lines, a low-pass filter for decoupling the supply voltage and the powerline communication can also be provided upstream of a consumer 12 or the closure drive 3. The same can of course also be provided on the station side, upstream of the power supply 17.

For monitoring the locking status of a closure device 5 of a vehicle 4 of a cableway 1, it is provided that the current collector 11 of the vehicle 4 contacts a first busbar 10, arranged in the station 2, when traveling through the station 2 in a direction of movement, at least after the closing and locking of the closure device 5. As explained above, the first busbar 10 is connected to the cableway controller 13 via a first station powerline modem 16, and the current collector 11 on the vehicle 4 is connected to a vehicle powerline modem 15. After the closing and locking of the closure device 5, the locking status is queried from the locking evaluation unit 14 by the locking monitor 8 and sent via powerline communication with the vehicle powerline modem 15 via the busbar 10 and the first station powerline modem 16 to the cableway controller 10. In the event of defective locking of the closure device 5, the cableway 1 is stopped by the cableway controller 13, as a result of which the vehicle 4 comes to a standstill after a certain distance. A second busbar 10' is arranged in the station 2, which busbar is connected to the cableway controller 13 via a second station powerline modem 16'. This second busbar 10' is arranged in the direction of movement after the first busbar 10 such that, after stopping, the vehicle 4 comes to a standstill in the region of the second busbar 10'. The vehicle 4 standing in the region of the second busbar 10' transmits the locking status again, at least once, with the vehicle powerline modem 15 via the second busbar 10' and the second station powerline modem 16' to the cableway controller 13. For this purpose, the locking status is again acquired from the locking evaluation unit 14 by the locking monitor 8. The cableway 1 is only started by the cableway controller 13 when correct locking of the closure device 5 has been signaled by the re-transmitted locking status.

Instead of a separate second busbar 10', however, the first busbar 10 could also be designed to be correspondingly longer. The first busbar 10 is to be designed to be of such a length that the vehicle 4 comes to a standstill after stopping in the region of the busbar 10. Thus, just one station powerline modem 16 would also be sufficient for powerline communication.

When two separate busbars 10, 10' are used, it is also possible to provide just one power supply 17 and to electrically connect the two busbars 10, 10'. Thus, just one station powerline modem 16 would also be sufficient for powerline communication.

The advantage of two separate and electrically separated busbars 10, 10' is that the lengths of the busbars 10, 10' can be designed such that at all times just one vehicle 4 can be located in the region of a busbar 10, 10', which can facilitate data communication.

During the closing and locking, however, the vehicle 4 does not necessarily have to be connected via the current collector 11 to a busbar 10, 10', also not during the querying of the locking status from the locking monitor 8 by the locking evaluation unit 14. The vehicle 4 must be connected to the busbar 10, 10' via the current collector 11 only at the time of the transmission of the locking status by means of powerline communication with the vehicle powerline modem 15 from the vehicle 4 via a busbar 10, 10' to a station powerline modem 16, 16'.

As soon as the current collector 11 of the vehicle 4 contacts a busbar 10, 10' in the station 2, the connection for powerline communication can be established. The busbars 10, 10' are thus arranged in the station 2 at least at a location where powerline communication is required for transmitting the locking status. In the simplest case, the vehicle powerline modem 15 and the station powerline modem 16, 16' ascertain an existing connection, for example by receiving a carrier frequency sent by one of the connected powerline modems 15, 16, 16', and start the powerline communication. The establishment of the connection can also comprise the start-up of the locking evaluation unit 14 and the vehicle powerline modem 15, for example if these were previously without a power supply and are now electrically supplied via the busbar 10, or no powerline communication was to be carried out previously. In this case, at the same time, an electrical closure controller of the closure drive 3 of the vehicle 4 can also be started up when said controller is supplied with electrical energy via the busbar 10. "Starting up" means, for example, that the vehicle powerline modem 15 generates the carrier frequency of the powerline communication and is applied to the current collector 11 by the vehicle powerline modem 15, whereby the powerline communication can take place. This typically takes approximately 1 to 2 seconds.

Figure 3:
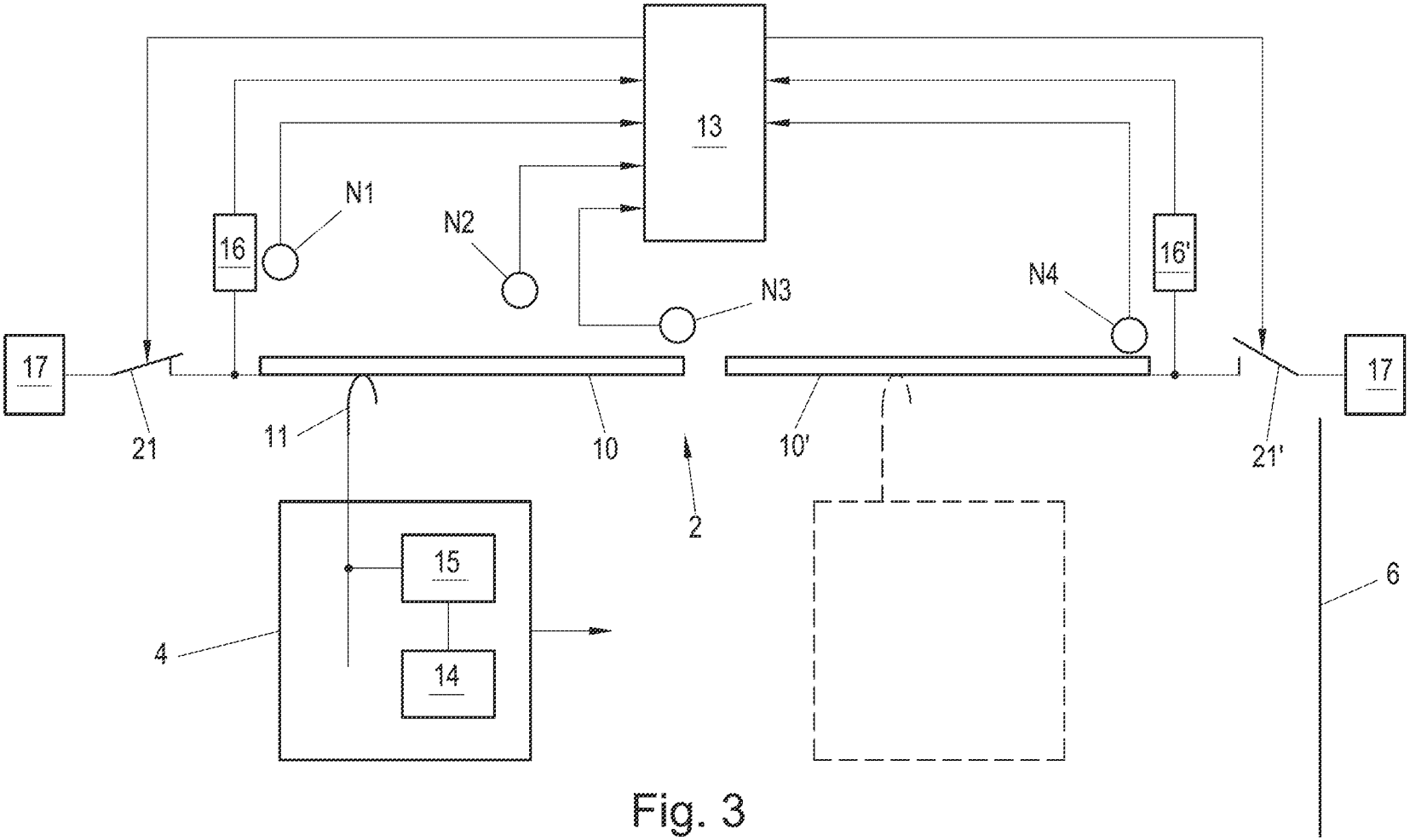
FIG. 3 is a schematic view of advantageous embodiment of locking monitoring of the closure device.

The function of monitoring the locking of the closure device 5 by the locking unit 7 is explained below with reference to FIG. 3, which shows an advantageous embodiment of the locking monitor. The example shows the closing of the closure device 5 of the vehicle 4 before the vehicle 4 exits from the station 2.

The vehicle 4 moves in the direction of movement (indicated by the arrow) through the station 2. When the vehicle 4 arrives in the region of a first busbar 10, the busbar 10 is activated, for example by the separation unit 21 of the power supply 17 (which was previously open) being closed. This is preferably carried out after the current collector 11 has contacted the busbar 10, in order to prevent sparking. For this purpose, for example, a first proximity switch N1 can be provided in the station 2 which detects the position of the vehicle 4. The position of the vehicle 4 in the station 2, in particular relative to the busbar 10, can, however, of course also be detected in any other way, for example by evaluating the known speeds of the vehicle 4 in the station 2.

However, it should be noted that the first busbar 10 can also be energized before contact of the current collector 11 or also permanently, for example if the resulting sparking does not constitute a problem. However, an interruption of the current flow at the time of contact, in order to prevent sparking, could also be implemented on the vehicle side. In these embodiments, the first proximity switch N1 can also be dispensed with.

If the first busbar 10 is used only for powerline communication and not for transmitting electrical energy from the station 2 to the vehicle 4, the first proximity switch N1 can also be dispensed with.

When the vehicle 4 continues to travel, the closure drive 3 closes the closure device 5, and the locking unit 7 locks the closure device 5. The first busbar 10 preferably supplies an electrical closure drive 3 with electrical energy. In this case, the length and the start of the busbar 10 in the station 2 are to be adjusted accordingly, as a function of the time required for the actuation of the closure drive 3. After closing and locking of the closure device 5, the locking status is acquired from the locking evaluation unit 14 via the locking monitor 8. The closing process can begin, for example, as soon as the closure controller of the electrical closure drive 3 is started up, or a certain time span or distance after the first proximity switch N1, or when a certain position of the vehicle 4 relative to the busbar 10 has been reached.

Provision can also be made to give a closing command or an opening command to an electrical closure drive 3 via the polarity of the supply voltage applied to the busbar 10, for example ±24 VDC. For example, a positive voltage could bring about the opening and a negative voltage could bring about the closing.

After closing and locking the closure device 5, the busbar 10 is deactivated in this exemplary embodiment. A second proximity switch N2 can also be provided for this purpose, by means of which a specific position of the vehicle 4 in the region of the busbar 10 is signaled to the cableway controller 13. As previously, a different position detection can also be provided instead of the second proximity sensor N2. During deactivation, the current collector 11 is still in contact with the busbar 10, and the deactivation can take place by the cableway controller 13 opening the separating unit 21 of the power supply 17. After the busbar 10 has been deactivated, the electrical energy storage 20 supplies the vehicle powerline modem 15 and the locking evaluation unit 14 with electrical energy, at least for a sufficiently long period of time.

Between the time of deactivation of the busbar 10 and the reaching of the end of the busbar 10, at which the contact between the current collector 11 and the busbar 10 is interrupted by the movement of the vehicle 4, the powerline communication for transmitting the locking status to the cableway controller 13 by means of the powerline modems 15, 16 takes place. The electrical energy storage 20 is therefore dimensioned accordingly, in order to be able to provide the electrical power required for the powerline communication. The end of the busbar 10 can again be recognized by means of a third proximity switch N3, or by any other position detection.

If only one busbar 10 is used, the proximity switch N3 can of course be omitted.

If the correct locking was reported to the cableway controller 13 as the locking status, the vehicle 4 passes the end of the busbar 10 and the second busbar 10' remains deactivated and the vehicle 4 moves out of the station 2. The same applies analogously if only a single busbar 10 is used.

If, on the other hand, defective locking has been reported to the cableway controller 13 as the locking status, the cableway controller 13 stops the cableway 1 due to the defective locking. After a certain braking distance, the vehicle 4 comes to a standstill (indicated by dashed lines in FIG. 3). A second busbar 10' is arranged in the station 2, downstream of the first busbar 10 in the direction of movement. This second busbar 10' is arranged in the station 2 such that the vehicle 4 comes to a standstill at all possible driving speeds of the vehicle 4 at the end of the first busbar 10 in the region of the second busbar 10', and not in the intermediate space between the two busbar 10, 10'. In the case of an emergency stop of the cableway 1 due to defective locking at the end of the first busbar 10, at least the distance between the two busbars 10, 10' and at most the distance up to the end of the second busbar 10' must thus be traversed. In the case of only one busbar 10, the length thereof is to be dimensioned such that in the event of an emergency stop due to defective locking the vehicle 4 comes to a standstill in the region of the busbar 10 at all possible driving speeds of the vehicle 4.

It is thus ensured that the vehicle 4 always comes to a standstill in the region of a busbar 10, 10', irrespective of the driving speed, prior to the deactivation of the cableway 1. During standstill, the vehicle 4 contacts the busbar 10, 10' via the current collector 11. This can also be checked by a fourth proximity switch N4 at the end of the busbar 10, 10', or by another position detection. A person skilled in the art can easily carry out such a design. This also ensures that the vehicle 4 stops within the station 2 before the vehicle reaches the station exit 6 and moves out of the station 2.

When the vehicle 4 is at a standstill in the region of the second busbar 10', the second busbar 10' can be activated, for example by the cableway controller 13, which closes a second separating unit 21' for connecting the second busbar 10' to a power supply 17. The power supply 17 can be the same as provided for the first busbar 10, but can also be another. Also when only one busbar 10 or two separate but electrically connected busbars 10, 10', are used, the busbar can be activated again if it has been previously deactivated.

However, it should be noted that the second busbar 10' can also be energized before the contact of the current collector 11 or also permanently, for example if the resulting sparking does not constitute a problem. However, an interruption of the current flow at the time of contact, in order to prevent sparking, could also be implemented on the vehicle side. If the second busbar 10' is used only for powerline communication and not to transmit electrical energy from the station 2 to the vehicle 4, then the second busbar 10' does not have to be energized at all, as a result of which the second separating unit 21' could also be omitted.

When the vehicle 4 is at a standstill after the emergency stop in the region of a busbar 10, 10', the restarting of the cableway 1 is blocked by the cableway controller 13 until the locking of the closure device 5 has taken place. For this purpose, the locking status of the locking unit 7 in the region of the busbar 10, 10' is determined again at least once and transmitted via powerline communication via the busbar 10, 10' and the second station powerline modem 16, 16' to the cableway controller 13. In the exemplary embodiment according to FIG. 3, the powerline communication for transmitting the locking status takes place for example via the vehicle powerline modem 15 and the second station powerline modem 16' which is connected to the second busbar 10' and to the cableway controller 13.

The checking and/or establishment of the correct locking can be carried out by the operating personnel of the cableway 1. For example, the operating personnel can manually check the stationary vehicle 4 in the region of the busbar 10, 10' and, if necessary, carry out the locking manually. The locking status can be queried at certain time intervals by the locking evaluation unit 14 and transmitted to the cableway controller 13.

However, bidirectional power line communication can also be provided, by means of which the cableway controller 13 can initiate the transmission of the locking status from the vehicle 4, for example by means of a command transmitted by powerline communication to the locking evaluation unit 14.

Such bidirectional powerline communication can also be used to initiate the opening or closing of the closure device 5 or the locking from an operating station. After each closing, the locking status can be queried and transmitted to the cableway controller 13.

If the locking of the closure device 5 can be established in this way, the cableway controller 13 can start up the cableway 1 again, and the vehicle 4 can move out of the station 2. It can be provided that the cableway controller 13 automatically restarts the cableway 1 when the correct locking is detected, or only when the operating personnel acknowledges the previous error state in the cableway controller 13.

If the locking cannot be restored, for example due to a defect on the vehicle 4, it can be provided to deactivate the function of the locking monitor in the cableway controller 13 for this vehicle 4 once. This can take place, for example, after all persons have left the vehicle 4, or if the correct locking of the closure device 5 has been checked manually by the operating personnel. The vehicle 4 can then be taken out of operation, for example.

Due to the redundant control of the locking status, sufficient fail-safety of the locking monitor can be established. Due to errors in the data transmission of the locking status via powerline communication, a correct locking could be signaled to the cableway controller 13, even though the locking of the closure device 5 on the vehicle did not take place correctly. The vehicle 4 could thus move out of the station 2 with incorrect locking of the closure device 5. In order to prevent such errors in the data transmission, sufficiently known error correction methods of digital data transmission can be used in the data communication protocol of the powerline communication. Such error correction methods generally add additional redundancy to the payload data to be transmitted (locking status), usually in the form of additional bits which are used on the target side for detecting errors and for determining the error position. For this purpose, error-detecting and error-correcting codes can also be used for the data transmission.

Exemplary embodiments of the disclosure have been described above to explain the principles of the present disclosure and its practical application to thereby enable others skilled in the art to utilize the present disclosure. However, as various modifications could be made in the constructions and methods herein described and illustrated without departing from the scope of the present disclosure, it is intended that all matter contained in the foregoing description or shown in the accompanying drawings, including all materials expressly incorporated by reference herein, shall be interpreted as illustrative rather than limiting. Thus, the breadth and scope of the present disclosure should not be limited by the above-described exemplary embodiment but should be defined only in accordance with the following claims appended hereto and their equivalents.

The invention claimed is:

1. A method for operating a cableway having at least one vehicle, wherein, at least in one station of the cableway, a closure device of the vehicle is closed with a closure drive and the closed closure device is locked by a locking unit, wherein a locking status of the locking unit is detected by a locking monitor and is transmitted to a cableway controller of the cableway, and the travel of the vehicle out of the station is prevented by the cableway controller in the event of defective locking, comprising the steps of:

contacting a first busbar with a current collector of the vehicle during travel of the vehicle through the station in a direction of movement at least after the closing and locking of the closure device, wherein the first busbar is connected to the cableway controller by a first station powerline modem, and the current collector is connected to a vehicle powerline modem after the closing and locking of the closure device, querying the locking status from the locking monitor with a locking evaluation unit and transmitting the locking status to the cableway controller with the vehicle powerline modem via the first busbar and the first station powerline modem through powerline communication, and stopping the cableway with the cableway controller and, as a result of which, bringing the vehicle to a standstill near the first busbar or a second busbar that is configured after the first busbar in the direction of movement, wherein the second busbar is connected with one of the first station powerline modem or a second station powerline modem that is connected with the cableway controller, while the vehicle is standing near the first busbar or the second busbar, querying the locking status at least once from the locking monitor and transmitting the locking status again to the cableway controller with the vehicle powerline modem via the first busbar or the second busbar and the associated station powerline modem, and starting the cableway with the cableway controller when a correct locking of the locking unit has been signaled by the re-transmitted locking status.

2. The method according to claim 1, further comprising the step of supplying electrical energy to the locking evaluation unit and the vehicle powerline modem via the first busbar or the second busbar.

3. The method according to claim 1, further comprising the steps of, during travel through the station, contacting the first busbar with the current collector of the vehicle in a direction of movement before the closure device, wherein the closure drive comprises an electric drive, and supplying the electric drive with electrical energy via the first busbar.

4. The method according to claim 3, further comprising the steps of deactivating the first busbar after closing and locking of the closure device and before the locking status is transmitted, and suppling electrical energy to at least one of the locking evaluation unit and the vehicle powerline modem from an electrical energy store on the vehicle for transmitting the locking status by powerline communication.

5. A cableway having a station, at least one vehicle, and a cableway controller for controlling the cableway, wherein a closure device and a closure drive for closing the closure device are provided on the vehicle, and a locking unit for locking the closure device is provided on the vehicle, wherein a locking monitor for detecting the locking status of the locking unit is provided on the vehicle, and the vehicle transmits the locking status to the cableway controller, and wherein the cableway controller prevents the vehicle from traveling out of the station in the event of defective locking, the cableway comprising:

a current collector on the vehicle a first busbar in the station the current collector being configured to contact the first busbar when the vehicle travels through the station in a direction of movement at least after the closing and locking of the closure device;

a first station powerline modem connecting the first busbar with the cableway controller a vehicle powerline modem on the vehicle connected with the current collector, a locking evaluation unit on the vehicle and, following the closing and locking of the closure device, configured to query the locking status from the locking monitor and transmit the locking status to the cableway controller by the vehicle powerline modem via the first busbar and the first station powerline modem by powerline communication;

a second busbar arranged in the station after the first busbar in the direction of movement, a second station powerline modem connected to the cableway controller, wherein the second busbar is connected with one of the first station powerline modem or the second station powerline modem;

wherein the cableway controller stops the cableway in the event of defective locking, resulting in the vehicle coming to a standstill near the first busbar (10)

wherein the locking evaluation unit queries the locking status at least once from the locking monitor and again transmits the locking status with the vehicle powerline modem via the first busbar or the second busbar and the first or second station powerline modem to the cableway controller while the vehicle is near the first or second busbar; and wherein the cableway controller starts the cableway when a correct locking of the locking unit has been signaled by the re-transmitted locking status.

6. The cableway according to claim 5, wherein at least one of the first and second busbar are configured to supply electrical energy to at least one of the locking evaluation unit and the vehicle powerline modem.

7. The cableway according to claim 5, wherein the first busbar is further configured in the station to make contact with the current collector before closure of the closure device, wherein the closure drive comprises an electric drive, and wherein the first busbar is configured to supply electrical energy to the electric drive.

8. The cableway according to claim 7, further comprising an electrical energy store on the vehicle configured to supply electrical energy to at least one of the locking evaluation unit and the vehicle powerline modem for transmitting the locking status, and wherein the first busbar is deactivated after the closing and locking of the closure device and before the transmission of the locking status.

9. The method according to claim 1, further comprising the step of supplying electrical energy to at least one of the locking evaluation unit and the vehicle powerline modem from an electrical energy store on the vehicle.

10. The cableway according to claim 5, further comprising an electrical energy store on the vehicle configured to supply electrical energy to at least one of the locking evaluation unit and the vehicle powerline modem.

* * * * *